US005325552A

United States Patent [19]

Fong

[11] Patent Number: 5,325,552

[45] Date of Patent: Jul. 5, 1994

[54] VENTILATED MATTRESS STRUCTURE

[76] Inventor: Lin S. Fong, P.O. Box 82-144, Taipei, Taiwan

[21] Appl. No.: 89,587

[22] Filed: Jul. 12, 1993

[51] Int. Cl.[5] ..... A47C 27/14

[52] U.S. Cl. ..... 5/408; 5/481

[58] Field of Search ..... 5/400, 468, 475, 481

[56] References Cited

U.S. PATENT DOCUMENTS

| | | | |
|---|---|---|---|
| 3,974,532 | 8/1976 | Ecchuya | 5/468 |
| 4,194,255 | 3/1980 | Poppe | 5/481 |
| 4,980,940 | 1/1991 | Isshiki | 5/481 X |
| 5,160,785 | 11/1992 | Davidson, Jr. | 5/481 X |

FOREIGN PATENT DOCUMENTS

| | | | |
|---|---|---|---|
| 1310373 | 3/1973 | United Kingdom | 5/468 |

*Primary Examiner*—Michael F. Trettel
*Attorney, Agent, or Firm*—Alfred Lei

[57] ABSTRACT

This invention relates to an improved bed and in particular to one which is integrally made of foamed polyethylene and includes an upper member having a plurality of ventilation holes, a lower member having a plurality of ventilation holes, and a plurality of cylindrical members between the upper member and the lower member, whereby the bed is comfortable in use and may even be cleaned with water.

1 Claim, 4 Drawing Sheets

VENTILATED MATTRESS STRUCTURE

BACKGROUND OF THE INVENTION

It has been found that the spring bed sold in the marketplace is one containing spiral springs in a rigid frame. However, such a bed has the following inevitable drawbacks:

1. The springs will become fatigued after having used for a certain period of time thereby slanting the top surface of the bed to one side and therefore making the user uncomfortable in sleeping.
2. Such bed is heavy in weight thereby making it inconvenient and difficult to move from one place and another.
3. It takes a rather long period of time to make the user feel warm.
4. Such a bed does not have sufficient and desirable ventilation hence making an user feel cold in the winter and hot in the summer.
5. It does not possess desirable cushioning effect.
6. Such a bed cannot be cleaned with water thereby making the user live under insanitary conditions.
7. It cannot be retrieved when given up.

Therefore, it is an object of the present invention to provide a bed which may obviate and mitigate the above-mentioned drawbacks.

SUMMARY OF THE INVENTION

This invention relates to an improved bed.

It is the primary object of the present invention to provide a bed which is made of a single material.

It is another object of the present invention to provide a bed which can quickly recover its original shape or condition after being pressed.

It is still another object of the present invention to provide a bed which is lightweight.

It is still another object of the present invention to provide a bed which can make an user feel warm in a short time.

It is still another object of the present invention to provide a bed which can be retrieved when not in use any longer.

It is still another object of the present invention to provide a bed which is comfortable in use.

It is still another object of the present invention to provide a bed which can be washed with water.

It is a further object of the present invention to provide a bed which is heat resistant.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
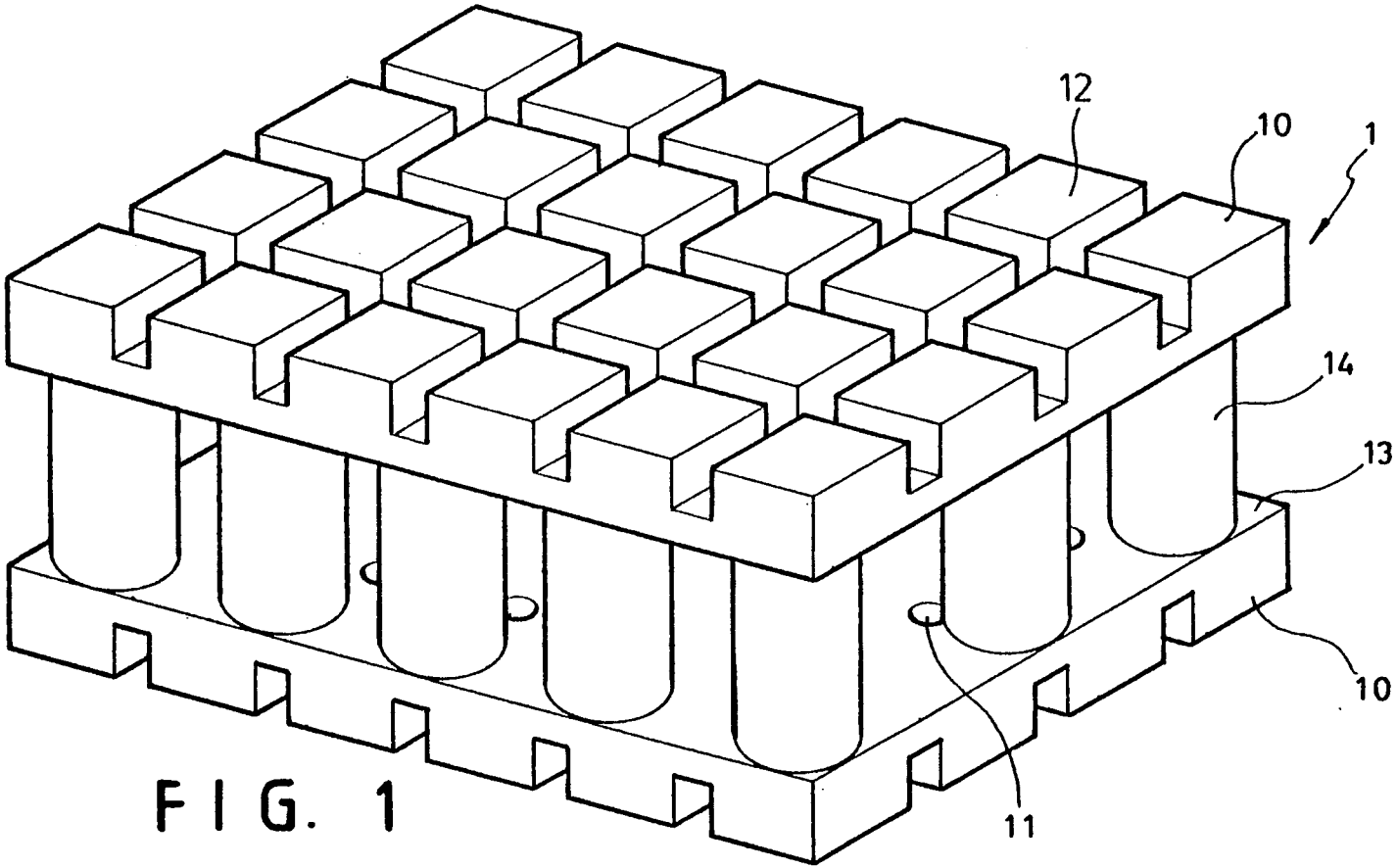
FIG. 1 is a perspective view of the present invention.
Figure 2:
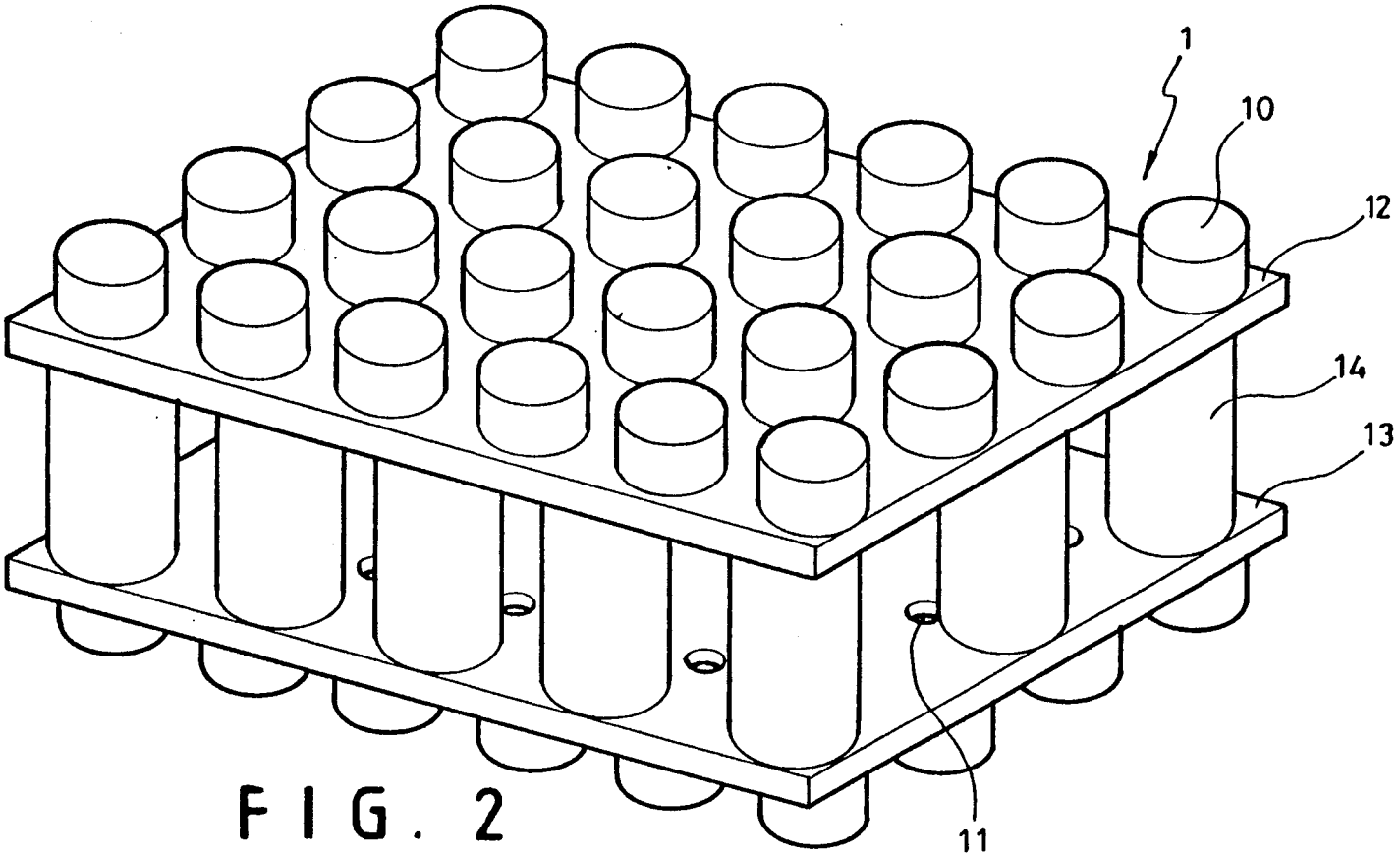
FIG. 2 shows a second preferred embodiment of the present invention.
Figure 3:
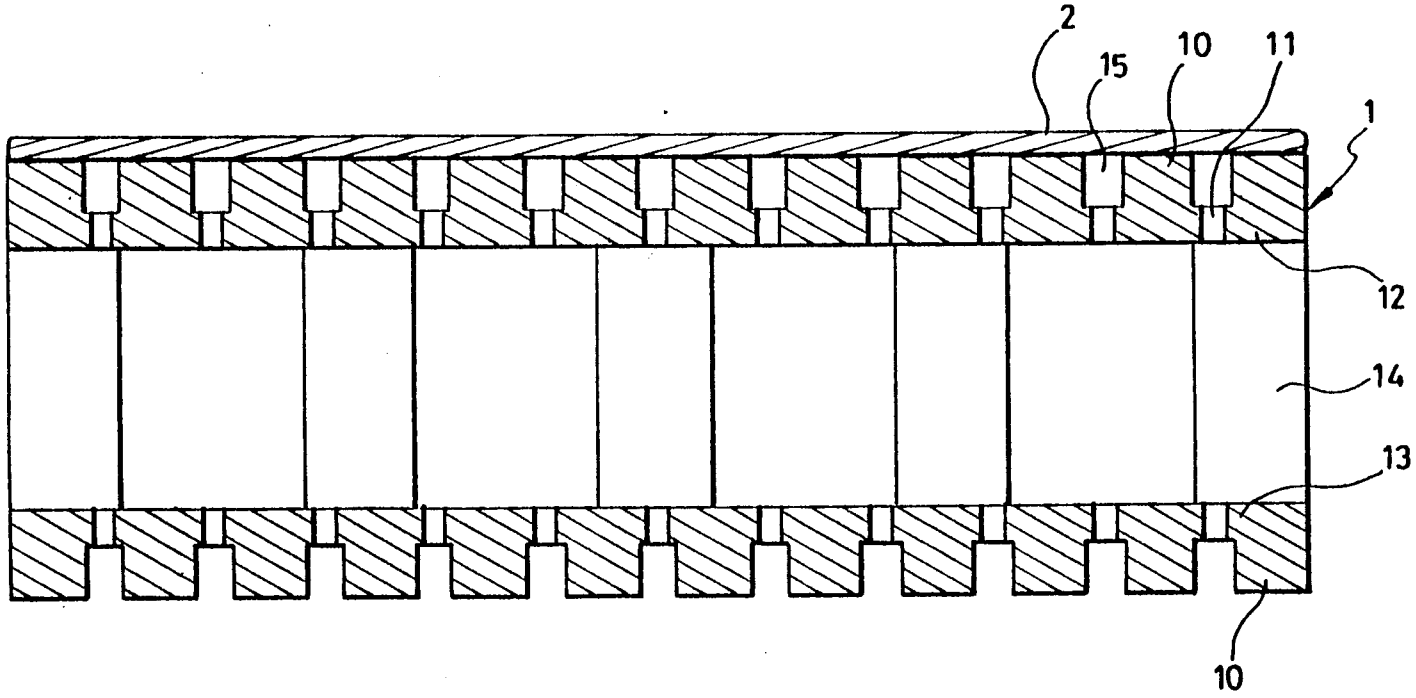
FIG. 3 is a sectional view of the present invention.

With reference to the drawings and in particular to FIGS. 1 and 3 thereof, the bed 1 according to the present invention is integrally made of foamed polyethylene and comprises an upper member 12, a lower member 13, and a plurality of cylindrical members 14 between the upper member 12 and the lower member 13. The upper member 12 has the same shape as the lower member 13 and is formed with a plurality of rectangular protuberances 10. The protuberance 10 may be shaped as a cylindrical member shown in FIG. 2. Further, the upper member 12 and the lower member 13 are provided with a plurality of ventilating holes 11.

When in use, top of the bed 1 is simply covered with a mattress 2 and the bed 1 will make the user feel warm in the winter and cool in the summer.

Figure 4:
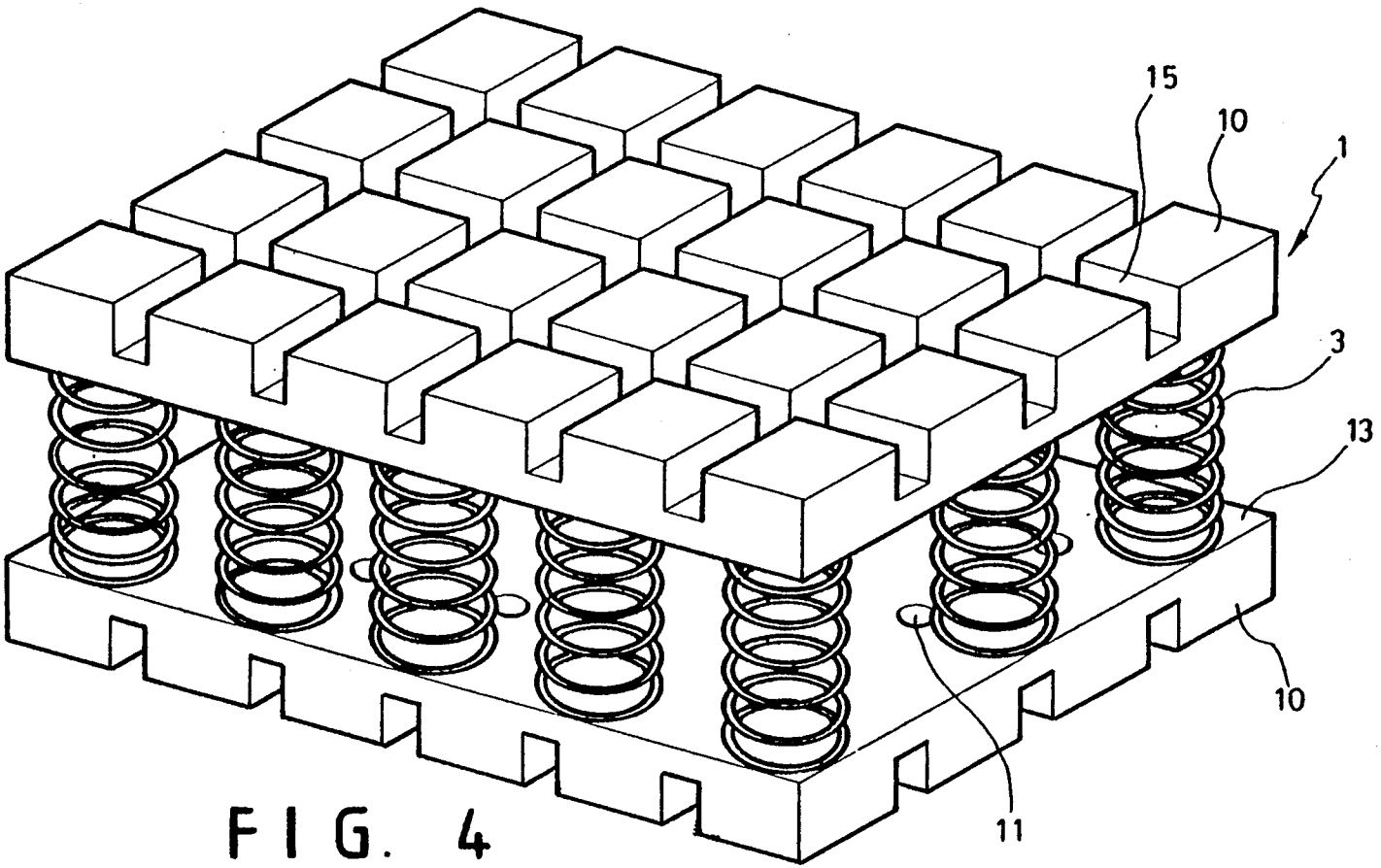
FIG. 4 shows a third preferred embodiment of the present invention.

In addition, the cylindrical members 14 may be replaced with springs 3 as desired (see FIG. 4).

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A bed comprising:

an upper member having a plurality of ventilation holes and a plurality of protuberances on a top, said upper member having a flat bottom;

a lower member having a plurality of ventilation holes and a plurality of protuberances on a bottom, said lower member having a flat top;

a plurality of cylindrical members located between said upper member and said lower member and formed integrally with the bottom of said upper member and the top of said lower member;

said bed being integrally made of foamed polyethylene.

* * * * *